United States Patent [19]

Rogers

[11] Patent Number: 4,524,676

[45] Date of Patent: Jun. 25, 1985

[54] HYDRAULIC CYLINDER LOCKING DEVICE

[75] Inventor: Larry K. Rogers, Lexington, Ky.

[73] Assignee: American Standard Inc., Lexington, Ky.

[21] Appl. No.: 572,265

[22] Filed: Jan. 19, 1984

[51] Int. Cl.[3] ..... F15B 15/26

[52] U.S. Cl. ..... 91/43; 91/44; 92/24; 92/27

[58] Field of Search ..... 91/43, 44, 394, 408, 91/409; 92/24, 27, 28

[56] References Cited

U.S. PATENT DOCUMENTS

| | | | |
|---|---|---|---|
| 2,181,562 | 11/1939 | Ganahl et al. | 91/408 |
| 2,349,244 | 5/1944 | Brown | 91/44 |
| 2,861,549 | 11/1958 | Gardener | 91/43 |
| 3,359,862 | 12/1967 | Modrich | 91/44 |
| 3,889,576 | 6/1975 | Sheffer et al. | 92/24 |
| 4,343,228 | 8/1982 | Wallis | 91/408 |

FOREIGN PATENT DOCUMENTS

| | | | |
|---|---|---|---|
| 384715 | 11/1923 | Fed. Rep. of Germany | 91/44 |
| 7506704 | 12/1975 | Netherlands | 92/28 |

*Primary Examiner*—Robert E. Garrett
*Assistant Examiner*—Richard S. Meyer
*Attorney, Agent, or Firm*—G. E. Hawranko

[57] ABSTRACT

A hydraulic cylinder having a locking device disposed in either, or both head ends which attach to the cylinder, has a piston reciprocally movable within a piston chamber formed in the cylinder. A stud member having a groove portion and a stud portion, secures to the piston for reciprocal movement therewith. The stud member axially moves within a stud bore formed in the head end such that, the stud bore acts as a variable volume stud chamber. A plunger member, disposed in the head end, is in fluid communication with the variable volume stud bore such that, movement of the stud member into the stud bore increases the fluid pressure, thus forcing the plunger out of contact with the stud portion of the stud member. When a predetermined pressure occurs, an outlet valve to the stud bore opens, reducing the fluid pressure and allowing the plunger to be urged into engagement with the groove portion of the stud member thus effecting a locked condition. An inlet valve to the stud bore allows introduction of additional fluid pressure to the stud bore sufficient to force the plunger out of engagement with the groove portion of the stud member, thus effecting an unlock of the cylinder. A common passageway communicates with both the inlet and outlet valves simultaneously, thus preventing the valve opposite the one operating, from itself operating.

13 Claims, 3 Drawing Figures

HYDRAULIC CYLINDER LOCKING DEVICE

BACKGROUND OF THE INVENTION

This invention relates to a locking device for a hydraulic cylinder, particularly a hydraulic cylinder which must be securely locked in either the fully-extended position, or the fully-retracted position. Typical hydraulic cylinder locking devices, to date, have employed either a strictly mechanical locking arrangement, a strictly hydraulic locking arrangement, or where a combined mechanical/hydraulic device has been provided, the mechanical and hydraulic portions were not used in a cooperative manner. In the case of the mechanical approach, certain components are exposed to extreme straining forces, resulting in excessive wear on those components. Generally, such high wear components comprise a spring-biased plunger movable over a cam portion formed on the piston rod whereby the spring, plunger, and cam portions require frequent maintenance and replacement. Another mechanical approach employs a clamping arrangement to the piston rod, such clamping arrangement also experiences the same wear and high stress problems previously discussed. In the case of the hydraulic approach, lock slippage due to leakage, or "give" of the seals, has been the most common problem, such lock slippage resulting in the cylinder rod drifting from the original position.

Additionally, such hydraulic cylinder locking arrangements have been restricted as to the load range over which an individual locking device could operate. Typically, as the load requirement changed, it was necessary to substitute a different component such as, for example, a differnt-sized plunger.

SUMMARY OF THE INVENTION

The object of the invention, therefore, is to provide a hydralic cylinder locking device that can securely lock a piston to a fully-extended or a fully-retracted position while reducing the amount of wear at contact points between the mechanical components.

A further object of the invention is to substantially eliminate leakage associated with the hydraulic portion of the devie and, further, should there be some limited hydraulic system back pressure present in the cylinder controlling line, the lock-holding condition is maintained.

Yet another object of the invention is to provide such a locking arrangement which is effective over a range of loadholding requirements.

It is an even further object of the invention to utilize the advantageous features of both a mechanical locking design and a hydraulic locking design in such a manner as to negate the disadvantages of each design.

Briefly, the invention consists of a piston and piston rod reciprocally movable within a cylinder body. A pair of cylinder heads attached to each end serve as the housing portions in which the locking arrangements are located. An open cylinder head allows for passage of the piston rod therethrough while, on the opposite end, a blind cylinder head has contained therein a stud portion which extends from the piston and engages the locking device. A manifold block attaches to the cylinder head to provide a connection to a fluid pressure source. Two oppositely disposed check valves regulate fluid flow into and out of the stud chamber, in which the stud portion is movable. A plunger, extending into the stud chamber, rides over a cam surface and engages a groove portion of the stud to lock the piston. The plunger is spring-loaded to maintain the locked condition until a fluid pressure level can lift the plunger out of engagement with the plunger to effect an unlock condition. The fluid pressure level in the stud chamber is not only controlled by an inlet check valve once the lock is set, but such fluid level is also controlled during transition to the locked position by an outlet check valve, thereby reducing frictional forces between mechanical components at this time as well. In the same manner as the hydraulic portion reduces the frictional forces acting on the mechanical components, the established locked condition between the mechanical components reduces the strain on the hydraulic seals.

DESCRIPTION AND OPERATION

Figure 1:
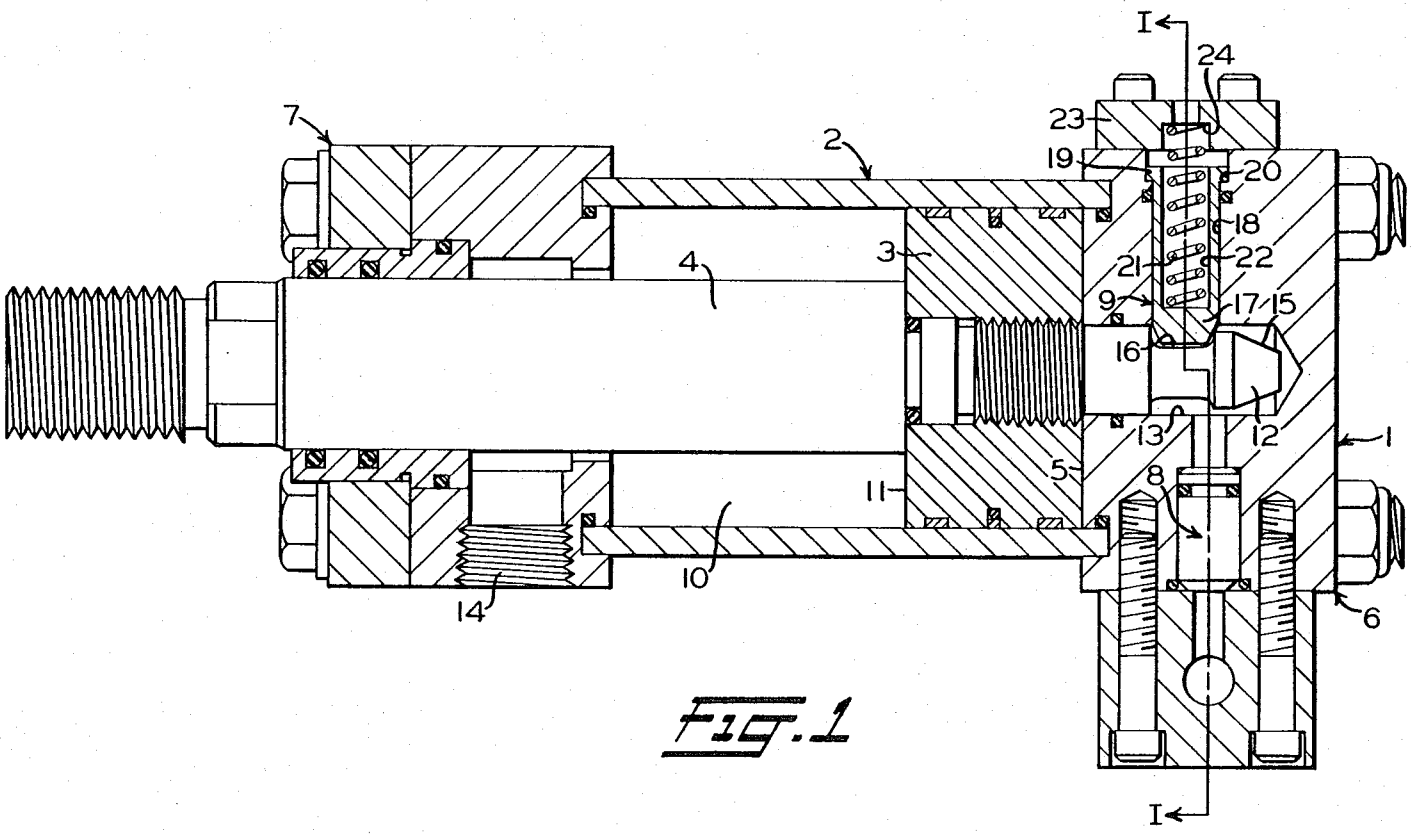
FIG. 1 is a horizontal view, in section, of a hydraulic cylinder locking device constructed in accordance with the invention.
Figure 3:
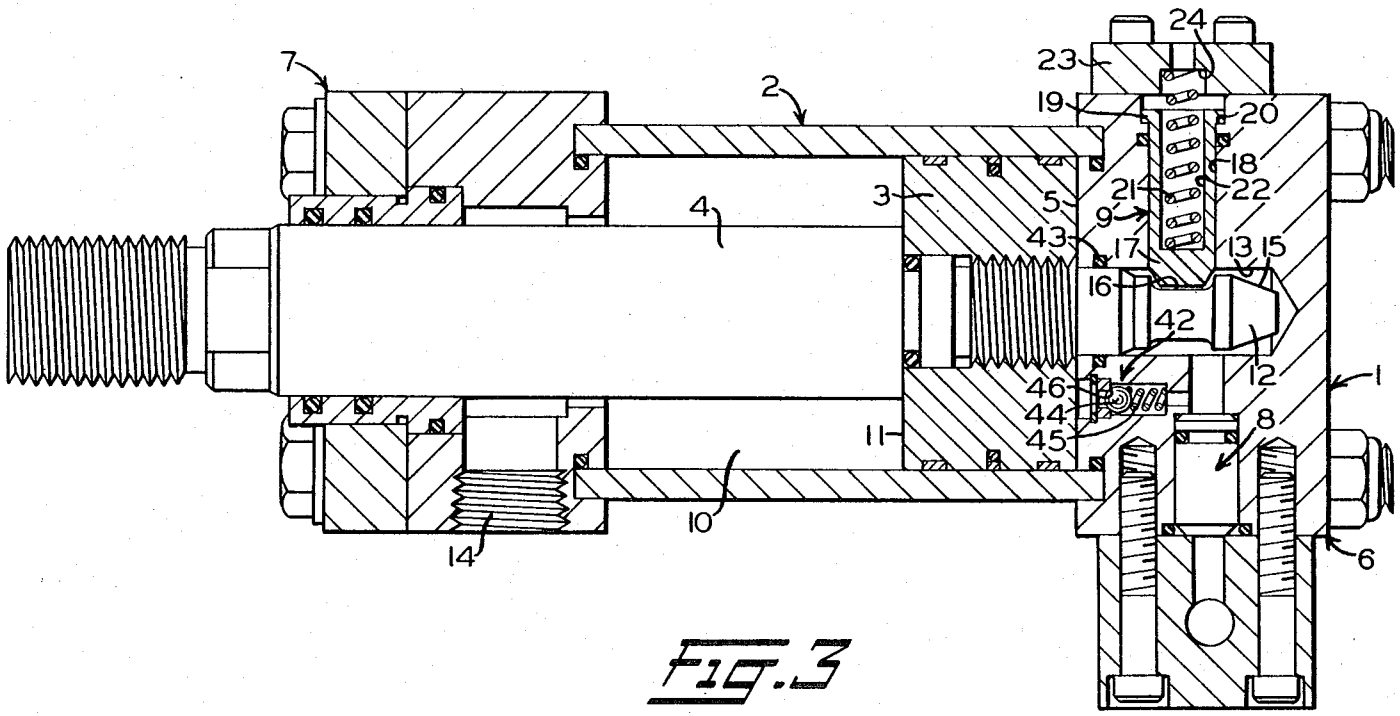
FIG. 3 is a horizontal view, in section, of an alternate embodiment of a hydraulic cylinder locking device.

As seen in FIGS. 1 and 3, a hydraulic cylinder locking device 1 is secured to one end of a hydraulic cylinder body 2. A piston 3, having a piston rod 4 connected thereto, is reciprocally movable within the cylinder body 2. FIG. 1 illustrates the locking device 1 attached to the blind head end 6 of the body 2. A piston chamber 5 is formed between the piston 3 and the blind head end 6. On the opposite end of the body 2, to the blind head and 6, is a rod head end 7. The piston rod 4 can extend outward through the rod head end 7 so that a cylinder-operated device (not shown) can be secured thereto.

Referring now to FIG. 1 only, it can be seen that the locking device 1 resides, in this instance, within the blind head end 6 and can be characterized generally as having a hydraulic portion 8 and a mechanical portion 9, both of which act on a stud member 12. The stud member 12 is movable within a stud bore 13 formed in the blind head end 6 adjacent the piston chamber 5. By securing the stud member 12 coaxially to the piston 3, movement of the stud member 12 into and out of the stud bore 13 occurs in a straightforward, aligned manner, thus preventing binding effects in the travel motion of the piston 3. Movement of the piston 3 into a position in which piston locking can be affected, is controlled by fluid pressure which can be supplied through pressure inlet 14 to the inlet chamber 10 which communicates with the side 11 of the piston 3 opposite the piston chamber 5. The stud member 12 is composed of a taper portion 15 and a groove portion 16.

FIG. 1 further illustrates the structure of the mechanical portion 9, and the engagement of the mechanical portion 9 with the groove portion 16, as occurs when movement of the piston 3 has occurred to the restricted position and the locking device 1 has been actuated. A plunger member 17 slides or reciprocates within a plunger bore 18 formed in the blind head end 6. A plunger stop 19, formed at the end of the plunger member 17, limits the stroke of the plunger 17 by contacting a shouler portion 20 formed adjacent the plunger bore 18. This shoulder portion 20 may be formed within the blind head end 6, as shown in FIG. 1, or may be formed merely by the outer edge surface of the blind head end 6. A bias spring 21 extends within a spring bore 22, formed coaxially within a portion of the plunger 17. A cap member 23 is secured to the blind head end 6 above the plunger bore 18 and forms the upper limit to the upward movement of the plunger 17 as occurs when the fluid pressure in stud bore 13 pushes the bottom portion of the plunger 17. A spring seat 24 formed within the cap member 23 receives one end of the bias spring 21.

Figure 2:
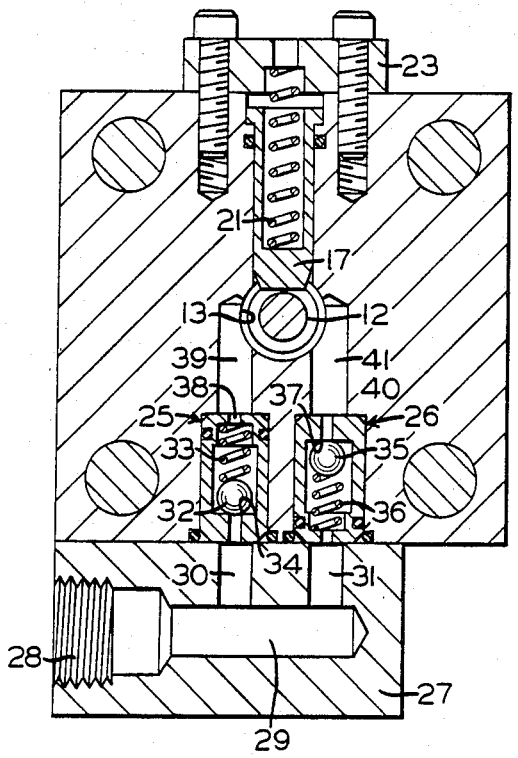
FIG. 2 is a cross-sectional view of a hydraulic cylinder locking device taken along line I—I of FIG. 1.

As seen in FIG. 2, the hydraulic portion 8 of the locking device 1 consists essentially of two zero leakage check valves 25, 26. A manifold portion 27 is secured to the bottom portion of the blind head end 6. A manifold inlet 28 and a manifold passageway 29 are formed within the manifold portion 27. A first valve passageway 30 and a second valve passageway 31 extend from the manifold passageway 29, and provide fluid communication for the first check valve 25 and the second check valve 26, respectively. The first and second check valves 25, 26 are oppositely disposed such that the first check valve 25 operates in the manner of an inlet valve and the second check valve 26 operates in the manner of an outlet valve. By orientating the first and second check valves 25, 26 in this opposite operating manner and, by extending the two check valves 25, 26 from the common manifold passageway 29, it can be appreciated that simultaneous operation of the two check valves is prevented. Furthermore, the first and second check valves 25, 26 are designed to open only after a predetermined cracking or opening pressure is achieved.

The first check valve 25 can be of a ball-type wherein a first valve ball 32 is urged by a first valve spring 33 to a closed position against a first valve seat 34. The first valve spring 33 maintains the first check valve 25 in the closed position until the cracking pressure for the first check valve 25 is reached or exceeded, thus moving the first valve ball 32 off the first valve seat 34, thereby compressing the first valve spring 33. The second check valve 26 can also be of the ball-type wherein a second valve ball 35 is urged by a second valve spring 36 to a closed position against a second valve seat 37. The second valve spring 36 maintains the second check valve 26 in the closed position until the cracking pressure for the second check valve 26 is reached or exceeded, thus moving the second valve ball 35 off the second valve seat 37 and compressing the second valve spring 36.

A first valve outlet 38 provides fluid communication between the first check valve 25 and a first outlet passageway 39 which is in communication with the stud bore 13. A second valve inlet 40 provides fluid communication between the second check valve 26 and a second inlet passageway 41, which is also in communication with the stud bore 13.

As seen in FIG. 3, a third check valve 42 can be installed in the blind head end 6 of the locking device 1 between the piston chamber 5 and the first outlet and second inlet passageways 39, 41. Additionally, a sealing element 43 is disposed around a portion of the stud bore 13 adjacent the piston chamber 5 or, alternatively, the sealing element can be disposed around the stud member 12. The orientation of the third check valve 42, together with the sealing element 43, allows fluid communication between the piston chamber 5 and the hydraulic portion 8 only through the opened third check valve 42, and only during movement of the piston 3 toward the blind head end 6. As in the case of the first and second check valves 25, 26, the third check valve 42 opens only after a predetermined cracking pressure has been reached or exceeded. The third check valve 42 can also be of the ball-type wherein a third valve ball 44 is urged by a third valve spring 45 to a closed position against a third valve seat 46. The third valve spring 45 maintains the third check valve 42 in the closed position until the cracking pressure of the third check valve 42 is reached or exceeded to move the third valve ball 44 off the third valve seat 46, thus compressing the third valve spring 45. It can be appeciated that the third check valve 42 and the sealing element 43 provide an alternative embodiment of the locking device which prevents hydraulic fluid present in the hydraulic portion 8 from reaching the face of piston 3.

In operation, the piston 3 has been moved to the fullyretracted position, as shown in FIG. 1, by the introduction of fluid pressure to the pressure inlet 14. As the piston 3 traveled to this fully-retracted position from some extended position, the stud member 12 moved along the same path of travel. Prior to the stud member 12 entering the stud bore 13, the plunger 17 was in the down position under the influence of the bias spring 21. As the piston 3 retracted, there was a pressure buildup in the stud bore 13 due to the arrangement of the first and second check valves 25, 26. The first check valve 25 prevented pressure from escaping the hydraulic portion 8 because it was oriented as an inlet valve, while the second check valve 26 initially prevented pressure from escaping the hydraulic portion 8 because the previously-discused cracking pressure for the second check valve 26 had not been achieved. As more fluid pressure is supplied to pressure inlet 14, the piston 3 will move toward the retracted position, causing an increase in the pressure level in the stud bore 13, until the pressure level reaches the cracking pressure of the second check valve 26, thus opening check valve 26. As long as the piston 3 continues to move in the retracting direction, the pressure level in the stud bore 13 will be at least the cracking pressure of the second check valve 26. The increased pressure level in the stud bore has the effect of reducing or substantially negating the frictional forces acting between the plunger 17 and the stud portion 12, as the stud portion 12 is moving into the stud bore 13. The pressure in the stud bore 13 causes the plunger to be moved upward against the force of the bias spring 21, thereby resulting in less wear to the mechanical portion 9. Whatever friction may exist between the stud portion 12 and plunger 17 is further reduced by the tapered structure of the tapered portion 15 of the stud 12 and the plunger 17.

When the piston 3 has been retracted, as shown in FIG. 1, and fluid pressure supplied to pressure inlet 14 has been relieved, the pressure level in the stud bore 13 will be reduced due to the piston 3 extending back a slight amount from the fully-retracted position. This reduction in the pressure level within the stud bore 13 allows the plunger 17 to move downward under the influence of bias spring 21 into locking engagement with the groove portion 16 of the stud member 12. The piston 3 is now locked in a retracted position.

If an external load is applied to the piston rod 4, the piston 3 will remain in the locked position due to the mechanical engagement of the plunger 17 and the stud member 12, and also due to the approximate vacuum-like condition of the hydraulic portion 8. The vacuum-like condition is a result of the first check valve 25 being oriented such that hydraulic fluid flows into the stud bore 13 only after the cracking pressure of the first check valve 25 is reached and the second check valve 26 has remained closed because of being oriented to allow hydraulic fluid to flow only in the outward direction therethrough. This shared responsibility of maintaining the locked condition serves to reduce the strain that would otherwise be experienced by a strictly hydraulic arrangement or a strictly mechanical arrangement. Additionally, the shared responsibility aspect provides a substantially fail-safe operation wherein, should either the mechanical portion 9 or the hydraulic portion 8 fail, the remaining operating portion could maintain the locked condition for some period of time.

To disengage the locking device 1, shown in FIG. 1, and thus allow the piston 3 and piston rod 4 to extend outward, hydraulic fluid is supplied to the manifold inlet 28. The hydraulic fluid will flow though the manifold passageway 29 and to the first and second valve passageways 30, 31. Initially, the first and second check valves will prevent hydraulic fluid from flowing into the stud bore 13 due to the pressure level not having reached the cracking pressure needed to open the first check valve 25 and the second check valve 26 being oriented such that hydraulic fluid only flows in the outward direction therethrough. As the pressure level at the first valve passageway 30 reaches the cracking pressure of the first check valve 25, the first check valve 25 will open, allowing hydraulic fluid to flow into the stud bore 13. The pressure level in the stud bore 13 will build up sufficiently to overcome the force of the bias spring 21, thereby urging the plunger in the upward direction out of engagement with the groove portion 16 of the stud member 12.

The operation of the locking device 1, shown in FIG. 3, is substantially similar to that describing the locking device 1 of FIG. 1. As the piston 3 is moving in the retracting direction, the pressure level in the piston chamber 5 will increase sufficiently to reach the cracking pressure of the third check valve 42, thus opening this third check valve 42. The fluid pressure present in the piston chamber 5 will then be communicated to the stud bore 13. Because the third check valve 42 and the sealing element 43 prevent fluid pressure from reaching the full area of piston 3 during disengagement of the locking device 1, the plunger 17 performance and first check valve 25 performance are enhanced due to the maintained integrity of the stud bore 13. The locking operation of the mechanical portion 9 and hydraulic portion 8 for the locking device 1, shown in FIGS. 1 and 3, are otherwise identical.

To disengage the locking device 1, illustrated in FIG. 3, fluid pressure must be introduced to the stud bore 13 through the first check valve 25 in the manner previously described. This fluid pressure must be of sufficient force to move the plunger 17 out of engagement with the groove portion 16 of the stud member 12, and to urge the stud member 12 in the extending direction with sufficient force to overcome the vacuum-like pressure in the piston chamber 5.

Though the above discussion has presented a locking arrangement for locking a hydraulic cylinder in a retracted position, it can be appreciated that the locking device can be installed on the rod head end 7 to operate with the same success when the hydraulic cylinder is in the extended position. Additionally, two locking devices can be installed such that the same hydraulic cylinder could be locked in both the extended and the retracted positions.

Although the hereinabove-described forms of embodiments of the invention constitute preferred forms, it can be appreciated that other modifications may be made thereto without departing from the scope of the invention as set forth in the appended claims. As an example, a plunger-type valve can be used in place of the three ball-type check valves 25, 26, 42. Additionally, instead of a spring-biased plunger 17, the plunger 17 can be pilot operated.

I claim:

1. A hydraulic cylinder with a locking device comprising:

(a) a cylinder body having a piston chamber formed therein and a head end on at least one end;

(b) a piston member reciprocally movable within said piston chamber;

(c) a stud member secured to said piston for reciprocal movement therewith, said stud member being axially movable within a stud bore formed in said head end such that, said stud bore is sealed into a variable volume stud chamber, said stud member having a groove portion and a stud portion, said stud portion being of smaller diameter than said stud bore;

(d) a plunger means extending through at least a portion of said head end having plunger surfaces for engaging said groove portion of said stud member;

(e) urging means for forcing said plunger means into engagement with said stud member;

(f) said plunger means being in fluid communication with said variable volume stud bore such that, upon travel of said stud member into said stud bore, said plunger means is forced in a direction opposite said urging means;

(g) fluid regulating means in communication with said stud bore for exhausting the fluid pressure in said stud bore following movement of said stud portion past said plunger surfaces, said fluid regulating means including a first check valve disposed as an outlet valve to said stud bore, said first check valve remaining closed until such fluid pressure in said stud bore increases under the influence of such stud portion movement sufficiently to urge said plunger means out of frictional contact with said stud portion, said first check valve thereafter opening upon such fluid pressure reaching a first predetermined cracking value; and (h) fluid delivery means for adding to the fluid pressure in said stud bore such that such fluid pressure acts on said plunger surfaces and said plunger member is forced out of engagement with said groove portion of said stud member, said fluid delivery means including a second check valve in communication with said bore and disposed as an inlet valve to said stud bore, said fluid delivery means, when engaged, further preventing operation of said fluid regulating means.

2. A hydraulic cylinder, as set forth in claim 1, wherein said plunger means includes a plunger member movable within a plunger bore formed in said head end adjacent said stud bore, said plunger member having a stop formed thereon for contacting said head end to limit movement of said plunger member.

3. A hydraulic cylinder, as set forth in claim 2, wherein said urging means includes a bias spring disposed in a spring bore formed within a portion of said plunger member.

4. A hydraulic cylinder, as set forth in claim 2, wherein said stop contacts a shoulder formed as a portion of said plunger bore.

5. A hydraulic cylinder, as set forth in claim 1, further comprising a manifold body secured to said head end portion and a first passageway formed in said manifold body in communication with an outlet of said first check valve.

6. A hydraulic cylinder, as set forth in claim 1, wherein said first check valve is a ball-type valve having a valve ball urged against a valve seat by a valve spring wherein said valve ball is urged off said valve seat when such first predetermined cracking pressure value is reached.

7. A hydraulic cylinder, as set forth in claim 5, further comprising a third check valve disposed between the piston chamber and said stud bore such that, said third check valve allows fluid pressure to flow from the piston chamber to said stud bore when a second predetermined cracking pressure for said third check valve has been reached.

8. A hydraulic cylinder, as set forth in claim 1, further comprising a manifold body secured to said head end, a first passageway in communication with an outlet of said first check valve, a second passageway in communication with an inlet of said second check valve, and a manifold passageway in communication with said first and second passageways simultaneously.

9. A hydraulic cylinder, as set forth in claim 8, further comprising a third check valve disposed between the piston chamber and said stud bore such that, said third check valve allows fluid pressure to flow from the piston chamber to said stud bore when a second predetermined cracking pressure for said third check valve has been reached.

10. A hydraulic cylinder, as set forth in claim 9, wherein at least two of said first, second and third check valves are ball-type valves, each having a valve ball urged against a valve seat by a valve spring wherein said valve ball is urged off said valve seat when a predetermined pressure value is reached.

11. A hydraulic cylinder, as set forth in claim 1, wherein said stud portion has a tapered slope.

12. A hydraulic cylinder, as set forth in claim 1, wherein said stud member is coaxially secured to said piston.

13. A hydraulic cylinder, as set forth in claim 3, wherein a cap member secures to said head end above said plunger bore, said cap member having a spring seat formed thereon to receive one end of said bias spring.

* * * * *